US007197788B2

(12) United States Patent
Yeung

(10) Patent No.: US 7,197,788 B2
(45) Date of Patent: Apr. 3, 2007

(54) RANGE HOOD CLEANING ASSEMBLY

(76) Inventor: Peter Yeung, 4446 Frances Street, Burnaby, British Columbia (CA) V5C 2R4

( * ) Notice: Subject to any disclaimer, the term of this patent is extended or adjusted under 35 U.S.C. 154(b) by 625 days.

(21) Appl. No.: 10/396,799

(22) Filed: Mar. 26, 2003

(65) Prior Publication Data

US 2003/0192529 A1 Oct. 16, 2003

(30) Foreign Application Priority Data

Apr. 12, 2002 (CA) ..... 2381721

(51) Int. Cl.
*A47L 5/00* (2006.01)
*A47L 9/00* (2006.01)
*F24C 15/20* (2006.01)

(52) U.S. Cl. ..... 15/301; 126/299 D; 126/299 E

(58) Field of Classification Search ..... 15/300.1, 15/301, 316.1, 405, 406; 126/299 R, 299 F, 126/299 D, 299 E
See application file for complete search history.

(56) References Cited

U.S. PATENT DOCUMENTS

| | | | | |
|---|---|---|---|---|
| 3,795,181 A | | 3/1974 | Lawson | |
| 4,085,735 A | | 4/1978 | Kaufman et al. | |
| 4,259,945 A | | 4/1981 | Lawson | |
| 4,784,114 A | * | 11/1988 | Muckler et al. | 126/299 E |
| 5,469,837 A | * | 11/1995 | Chiang et al. | 126/299 D |
| 5,507,841 A | * | 4/1996 | Heckman et al. | 15/301 |
| 5,537,988 A | | 7/1996 | Lin | |
| 5,680,672 A | * | 10/1997 | Baumann | 15/312.1 |
| 5,874,292 A | * | 2/1999 | McMinn, Jr. | 435/262 |
| 6,125,841 A | | 10/2000 | Boudreault | |
| 6,216,686 B1 | | 4/2001 | Chiu | |
| 6,651,648 B2 | * | 11/2003 | Kuang et al. | 126/299 R |
| 6,651,777 B2 | | 11/2003 | Suratt | |
| 6,662,800 B2 | * | 12/2003 | Yeung | 126/699 |
| 6,712,068 B1 | * | 3/2004 | Yeung | 126/299 E |
| 6,732,729 B2 | * | 5/2004 | Yeung | 126/299 D |
| 6,851,422 B2 | * | 2/2005 | Yeung | 126/299 E |
| 6,874,497 B2 | * | 4/2005 | Yeung | 126/299 E |
| 6,880,551 B2 | * | 4/2005 | Yeung | 126/299 E |
| 6,895,957 B2 | * | 5/2005 | Yeung | 126/299 E |
| 2004/0200027 A1 | * | 10/2004 | Sugihara | 15/301 |
| 2005/0016522 A1 | * | 1/2005 | Yeung | 126/299 D |
| 2005/0081842 A1 | * | 4/2005 | Yeung | 126/299 E |

FOREIGN PATENT DOCUMENTS

JP 2002-317985 * 10/2002

* cited by examiner

*Primary Examiner*—Terrence R. Till
(74) *Attorney, Agent, or Firm*—C. Larry Kyle; Nexus Law Group LLP

(57) ABSTRACT

A range hood cleaning assembly utilizes compressed air to drive accumulated grease on range hood surfaces towards drainage holes. A plurality of air dispensers, preferably air hoses and directional nozzles, through which compressed air from at least one source of compressed air is blown, direct compressed air against surfaces within a motor housing interior, on the fan(s) and within grease trays to drive accumulated grease towards drainage holes. The air dispensers may be attached to a plate mounted within the motor housing interior about a motor and above a fan, may be integral or releasably attachable to the motor housing or may be integral or releasably attachable to grease trays. The compressor may be set to activate automatically or may be activated manually.

23 Claims, 7 Drawing Sheets

RANGE HOOD CLEANING ASSEMBLY

FIELD OF THE INVENTION

This invention relates to range hoods, and more particularly to a cleaning assembly for a range hood wherein compressed air directs accumulated grease accumulated within the range hood to an external grease receptacle.

BACKGROUND OF THE INVENTION

Range hoods are used above cooking surfaces to remove grease, common odors and hazardous gases created during the cooking process. Typically, range hoods have a pair of motors horizontally installed in a motor housing within the hood body. Each motor drives a fan. The fans suck air from the cooking area below and force it through the motor housing to ventilation piping.

As the vaporized grease contained in the entrained air travels through the motor housing, some of it condenses on the inside walls of the housing from where the shaping of the walls and floor of the housing directs the grease to a circular grease catcher mounted below each fan opening. Grease catchers are known in the art as illustrated in U.S. Pat. Nos. 6,216,686 B1 and 5,537,988.

Grease catchers are also adapted to capture any grease that drips off the fan blades when the motors are turned off. Typically, the grease catcher has radial inner and outer trays with a wall separating them. The wall extends vertically so as to be almost flush with the lower edge of the outer circumference of the fan. In this way air being drawn in by the fans is compelled to enter the motor housing rather than the hood body. The wall therefore acts to control the air currents of the range hood.

The grease catchers are usually provided with an inclined base or floor, so as to direct accumulated grease to a hole in the floor. A hose is attached to the hole to convey the grease to a grease receptacle outside the range hood.

The motor housing and grease catchers are mounted within the hood body. Openings in the lower surface of the hood body are positioned so as to match those of the motor housing. Typically the lower surface of the hood body is removably fitted into the main hood body. A protective grill is attached to the outside of each opening in the hood body so as to prevent the insertion of body parts when the fan is in operation.

Alternatively, as set out in my U.S. and Canadian patent applications, numbers Ser. No. 10/035,116 and 2,365,790 respectively, the motor housing may be adapted to act as a grease catcher itself. In this system, a circular wall defining the motor housing intake openings projects vertically into the motor housing, acting as a barrier to grease accumulated therein. The accumulated grease drains directly from the housing rather than to a grease catcher. Grease trays inserted into the intake openings provide a barrier for proper airflow into the housing and to capture any grease that should happen to drip from the fan when it has stopped motion.

Both of the foregoing designs rely on gravity to cause the accumulated grease to drain out of the range hood. However, gravity is not effective in removing all the grease with the result that some becomes caked on to the interior surfaces, thereby reducing the efficiency of the range hood and creating a possible fire hazard.

The foregoing systems of motor housing and grease catchers therefore require periodic cleaning to remove condensed grease accumulated on the fans, motor housing interior and grease trays. In order to clean the interior of the range hood, a user must first remove the lower surface of the hood body, following which the grease catcher must then be removed. This can be quite awkward and is difficult for those without the strength to support the weight of the lower surface. Washing the inside of the motor housing, the fans and the grease trays to remove the accumulated grease is also time consuming.

Attempts have been made to overcome the necessity to manually clean the interior of a range hood exhaust system. It is known in the art to provide a washing fluid under pressure in order to clean the interior of the exhaust system. For example, U.S. Pat. No. 4,259,945 teaches an exhaust system in which a washing fluid under pressure is used to clean the flue and fan. Similar washing fluid systems are taught in U.S. Pat. Nos. 3,795,181 and 4,085,735.

A similar approach is known in the art with respect to the range hood design described above. A fluid delivering nozzle is fitted into a hole in the side of the motor housing so as to deliver a spray of washing fluid to clean the interior. This is done while the motors are activated so that the force of the air being drawn into the motor housing forces the sprayed fluid against the interior surfaces of the motor housing and prevents any liquid from passing through the air intakes.

While these prior art systems reduce the amount of cleaning required of the exhaust system, maintenance is still required. Because there is so much waste fluid resulting from the combination of the grease and the washing solution, a large waste fluid receptacle is required and must be emptied often. The waste receptacle takes up usable space below the range hood and is not pleasing to the eye. In addition, the washing fluid receptacle must be constantly refilled.

It is therefore an object of an embodiment of the present invention to provide a range hood in which the interior of the range hood, including the motor housing and the fans, may be automatically cleaned without the use of washing fluid so as to negate the need for a large waste fluid receptacle or the constant refilling of a washing fluid receptacle.

Various aspects of the invention address these objects, but not all aspects of the invention necessarily address all such objects simultaneously. Other objects of the invention will be apparent from the description that follows.

SUMMARY OF THE INVENTION

The invention is directed to a cleaning assembly for use in a range hood. According to one aspect of the invention, a plurality of air dispensers are used to direct compressed air against the grease laden surfaces of the range hood including the fan(s), the interior surfaces of the motor housing and, if applicable, the grease tray(s), thereby directing any accumulated grease out of the range hood.

In the preferred embodiment, the range hood has a motor housing encasing two motors, each motor contained within a separate chamber of the motor housing and driving a respective fan. At least one source of compressed air, such as an air compressor, acts to drive compressed air through air dispensers, the compressed air acting to force accumulated grease out of the range hood.

Preferably, the air dispensers will comprise air hoses with directional nozzles, however any suitable means of delivering compressed air is satisfactory; for example, hollow, rigid tubes or conduits.

Preferably, a plate is attached about the base of each motor, such that a portion of each of the motors is bordered by a plate. A space is present between the plate and the upper surface of the motor housing. A plurality of air dispensers is attached to each plate and is positioned between the plate surface and the upper surface of the motor housing. Compressed air is directed through each air dispenser such that it is directed against the upper surface of the motor housing. The air dispensers dispense the compressed air over a wide angle. In the preferred embodiment, four hoses and nozzles are attached to the plate. However, this number can be varied to provide different levels of cleaning efficiency. While it is preferred that the plate be circular, it need only be shaped so as to fit around the motor and to provide a surface upon which to mount the air dispensers and could for example be star-shaped or scalloped.

The compressed air forced against the upper surface of the motor housing drives any accumulated grease down the side of the interior to the lower surface of the motor housing where it drains to an outer grease receptacle.

In the preferred embodiment, intake openings in the lower surface of the housing are formed by walls that project into the interior of the motor housing (one for each chamber). An extension extends from the wall into the opening and in a downward direction so as to form a gap between the extension and the wall. The housing is shaped so as to direct any accumulated liquid or debris within the housing, such as grease, towards a drainage hole in the lower surface of the housing where the liquid is directed out of the range hood. An additional air dispenser is mounted in the side of the motor housing and acts to force liquid accumulated on the lower surface of the motor housing towards the drainage hole. The intake opening walls prevent any liquid from passing back through the intake opening.

Two further air dispensers are attached to the underside of the lower surface of the motor housing, one travelling towards each of the intake openings. These air dispensers direct compressed air travelling through them towards the blades of the fan mounted above each respective intake opening.

In one aspect the cleaning assembly is for use in a range hood comprising a motor housing having an interior defined by upper, lower and side surfaces containing at least one motor and at least one fan and having at least one drain hole. The cleaning assembly comprises at least one source of compressed air located externally to the motor housing and a plurality of air dispensers for delivering the compressed air to the motor housing interior.

In another aspect, the air dispensers direct the compressed air against at least one of the interior surfaces of the motor housing.

In another aspect the cleaning assembly further comprises a plate releasably attachable to the motor housing about the motor and above an upper surface of the fan such that there is a space between the plate and the motor housing.

In another aspect at least a first one of the air dispensers is mounted to the plate in the space.

In another aspect the air dispensers direct compressed air from the source of compressed air against the upper surface of the motor housing interior.

In another aspect a second one of the plurality of air dispensers is releasably attachable to the lower surface of the motor housing and directs compressed air from the source of compressed air against the at least one fan.

In another aspect at least a third one of said plurality of air dispensers is integral with the side of the motor housing, the third one of the air dispensers being positioned within the motor housing interior above a top side of the lower surface of the motor housing.

In another aspect the third one of the air dispensers directs compressed air from the source of compressed air against the top side of the lower surface of the motor housing.

In yet a further aspect the cleaning assembly according to the invention is for use in a range hood comprising a motor housing having an interior defined by upper, lower and side surfaces containing at least one motor and at least one fan, and a grease tray. The grease tray is releasably attachable to the motor housing and comprises an opening, first, second and third tray walls extending around the opening, a first trough formed between the first and second tray walls, a second trough formed between the second and third tray walls, and at least one drainage hole. The cleaning assembly comprises at least one source of compressed air located externally to the motor housing and a plurality of air dispensers for delivering the compressed air to the interior.

In another aspect a first of the plurality of air dispensers is integral with the first, second and third tray walls.

In another aspect the first of the air dispensers directs compressed air from the source of compressed air against the at least one fan.

In another aspect at least a second one of the plurality of air dispensers is integral with the first tray wall, the second one of the air dispensers directing compressed air from the source of compressed air into the first trough.

In yet a further aspect the invention comprises range hood cleaning assembly wherein the range hood has a motor housing having upper, lower and side surfaces that generally defines an enclosure containing at least one motor and at least one fan. The lower surface has at least one intake opening and at least one drain hole. A wall depending from the lower surface and projecting into the interior of the enclosure defines the intake opening. A tray is releasably connectable to the intake opening. The tray comprises an opening, first and second tray walls extending around the opening, and a floor between the first and second tray walls. The cleaning assembly comprises at least one source of compressed air located externally to the motor housing and a plurality of air dispensers for delivering the compressed air within the range hood.

In another aspect a second one of said plurality of air dispensers is releasably attachable to the lower surface of the motor housing. The second one of the air dispensers directs compressed air from the source of compressed air against the at least one fan. The first and second tray walls have a gap in which the second one of the air dispensers may be fitted when the tray is releasably connected to the intake opening.

In another aspect a second of said plurality of air dispensers is releasably attachable to the tray, the second air dispensers directing compressed air from the source of compressed air against the at least one fan when the tray is releasably connected to the intake opening.

In another aspect the air dispensers comprise air hoses and nozzles, each air hose having a first end connectable to the source of compressed air and a second end releasably connectable with a respective one of the nozzles.

In yet a further aspect the invention comprises a cleaning assembly for use in a range hood comprising a motor housing having an interior defined by upper, lower and side surfaces containing at least one motor and at least one fan and having at least one drain hole. The cleaning assembly comprises at least one source of compressed air, a plurality of air hoses wherein each of the plurality of air hoses having a first and second end, a plurality of nozzles wherein at least one nozzle is releasably connected to each of the first ends and each of the second ends are releasably connected to the source of compressed air.

In yet another aspect the nozzles direct compressed air from the source of compressed air against at least one of the interior surfaces of the motor housing whereby to dislodge grease and debris from the at least one interior surfaces.

Other aspects of the invention will be appreciated by reference to the detailed description of the preferred embodiment and to the claims that follow.

BRIEF DESCRIPTION OF THE DRAWINGS

The invention will be described by reference to the detailed description of the preferred embodiment and to the drawings thereof in which.

DETAILED DESCRIPTION OF THE PREFERRED EMBODIMENT

The present invention relates to a cleaning assembly for a range hood.

The cleaning assembly is composed of a source of compressed air such as a compressor and air dispensers for directing the compressed air against grease coated surfaces within the range hood. The compressed air is used to drive accumulated grease out of the range hood. This will be described in greater detail below by reference to the preferred and alternative embodiments.

Figure 1:
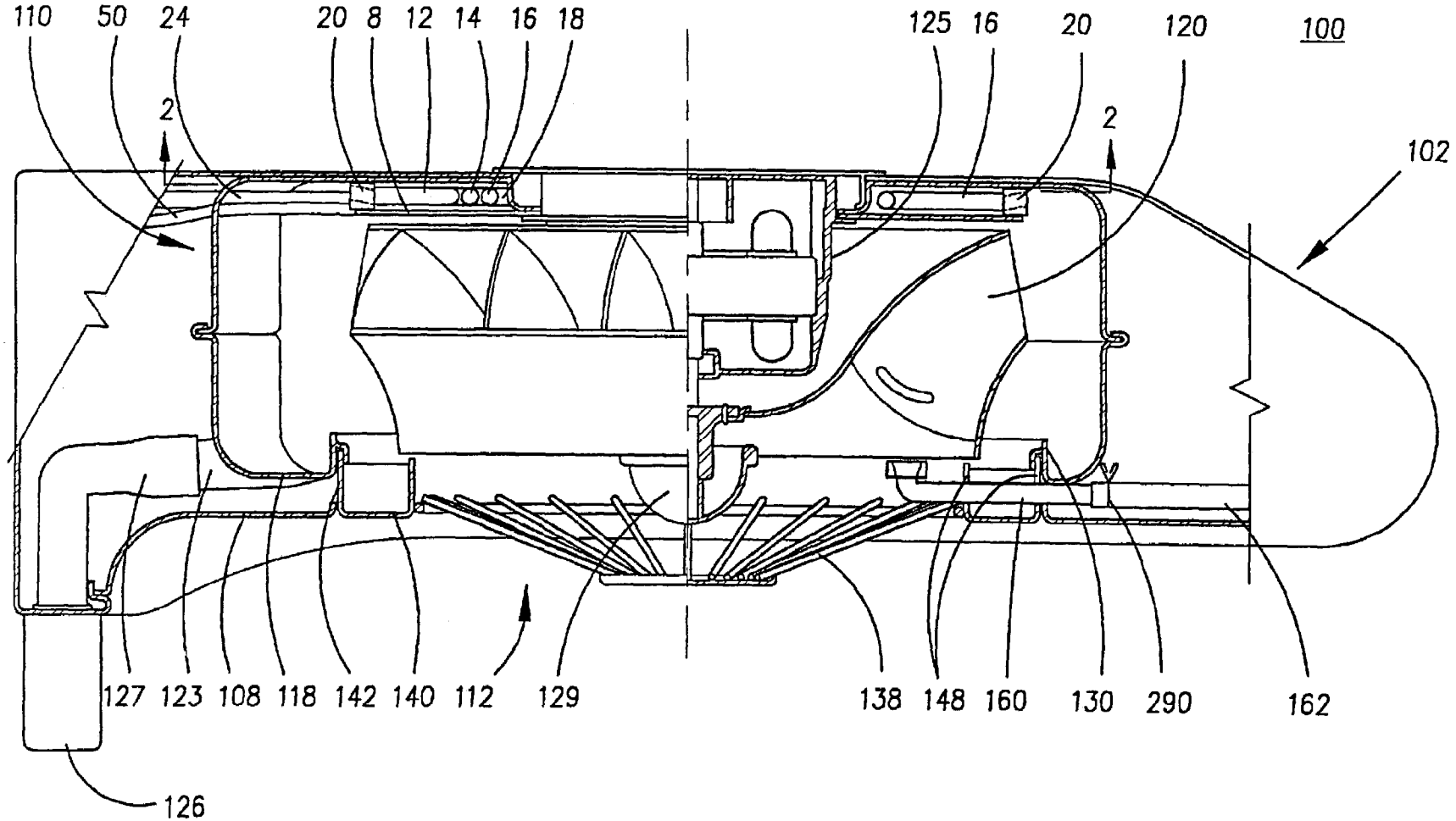
FIG. 1 is a sectional view of a range hood according to the preferred embodiment of the invention with the right hand portion of the figure providing a deeper sectional view than the left hand portion of the figure.
Figure 2:
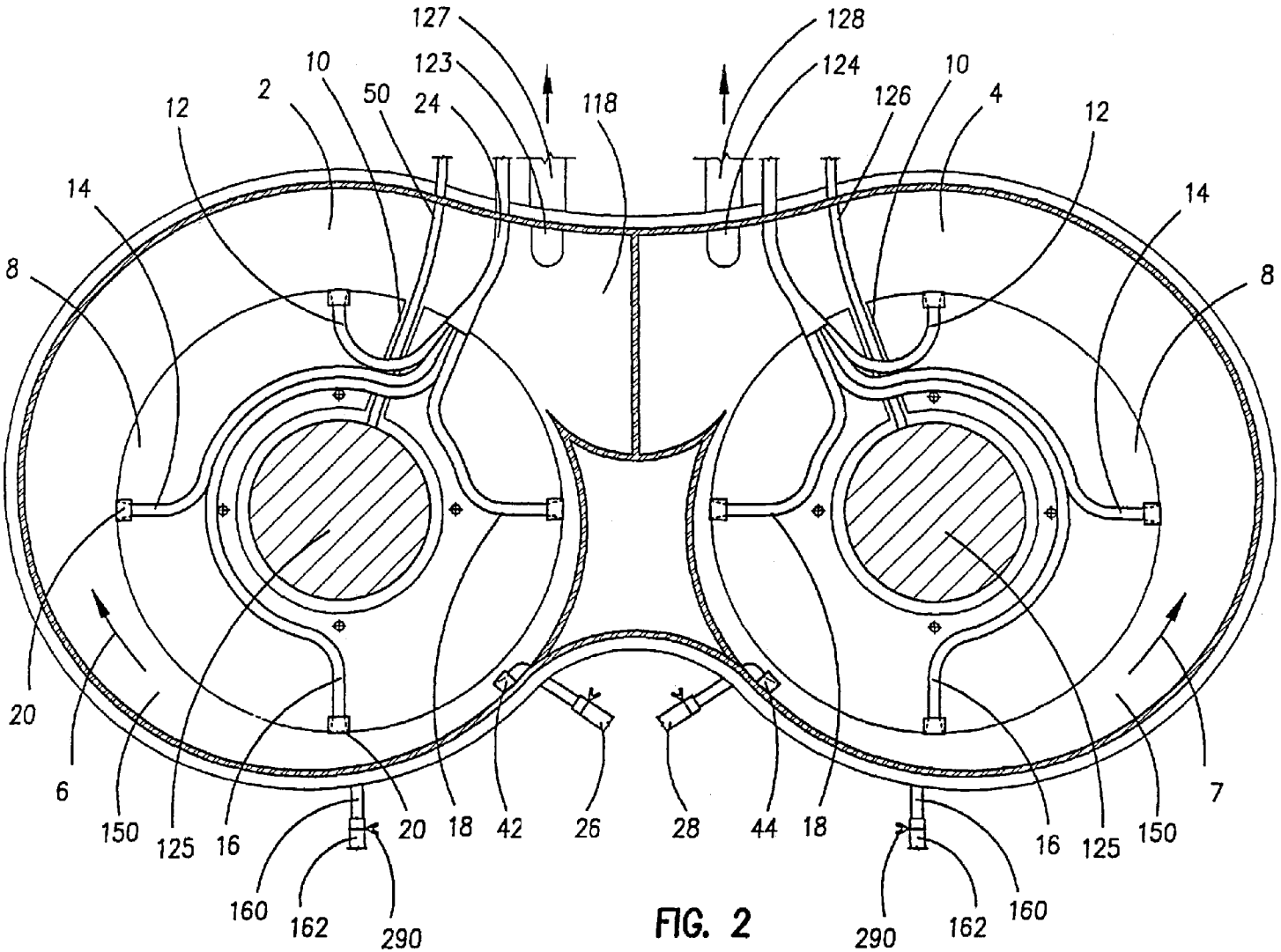
FIG. 2 is a view taken along line 2—2 of FIG. 1.

The preferred embodiment of a range hood 100 with a cleaning assembly according to the invention is illustrated in FIG. 1. In the preferred embodiment, the motor housing 110 includes an integral grease catcher. The housing 110 defines an enclosure and is mountable within a further enclosure formed by the hood body generally indicated by the numeral 102. The interior of the housing 110 is coated with a non-stick material so as to facilitate grease removal and is separated into two substantially similar, separate chambers 2, 4 as best illustrated in FIG. 2. The chambers 2, 4 have intake openings 112 shown in FIG. 3, and ventilation holes (not shown). The ventilation holes project through the upper surface of hood body 102 when the housing 110 is attached to the interior of the hood body 102.

Two motors 125 fit within the motor housing 110 and are attached to the inside of the upper surface of the hood body 102, one in each of chambers 2 and 4. Fans 120, of the semi-impeller type, one secured to each of the motors 125 by fan caps 129, act to draw grease-laden air into the motor housing 110 and out the ventilation holes. A plate, preferably shaped as a circular disc 8 is attached about the base of each of the motors 125 such that there is a space between plate 8 and the upper surface of the interior of motor housing 110. Preferably, the plate 8 has a maximum radius that is approximately equal to the maximum radius of the fans 120, the plates 8 being positioned just above the upper surface of the fans when they are installed in the motor housing 110. The plate acts to prevent the air dispensers from coming into contact with any moving parts, such as the fans 120, within the motor housing. The fans 120 and plate 8 are dimensioned so as to be removable from within the housing 110 through openings 112.

Figure 3:
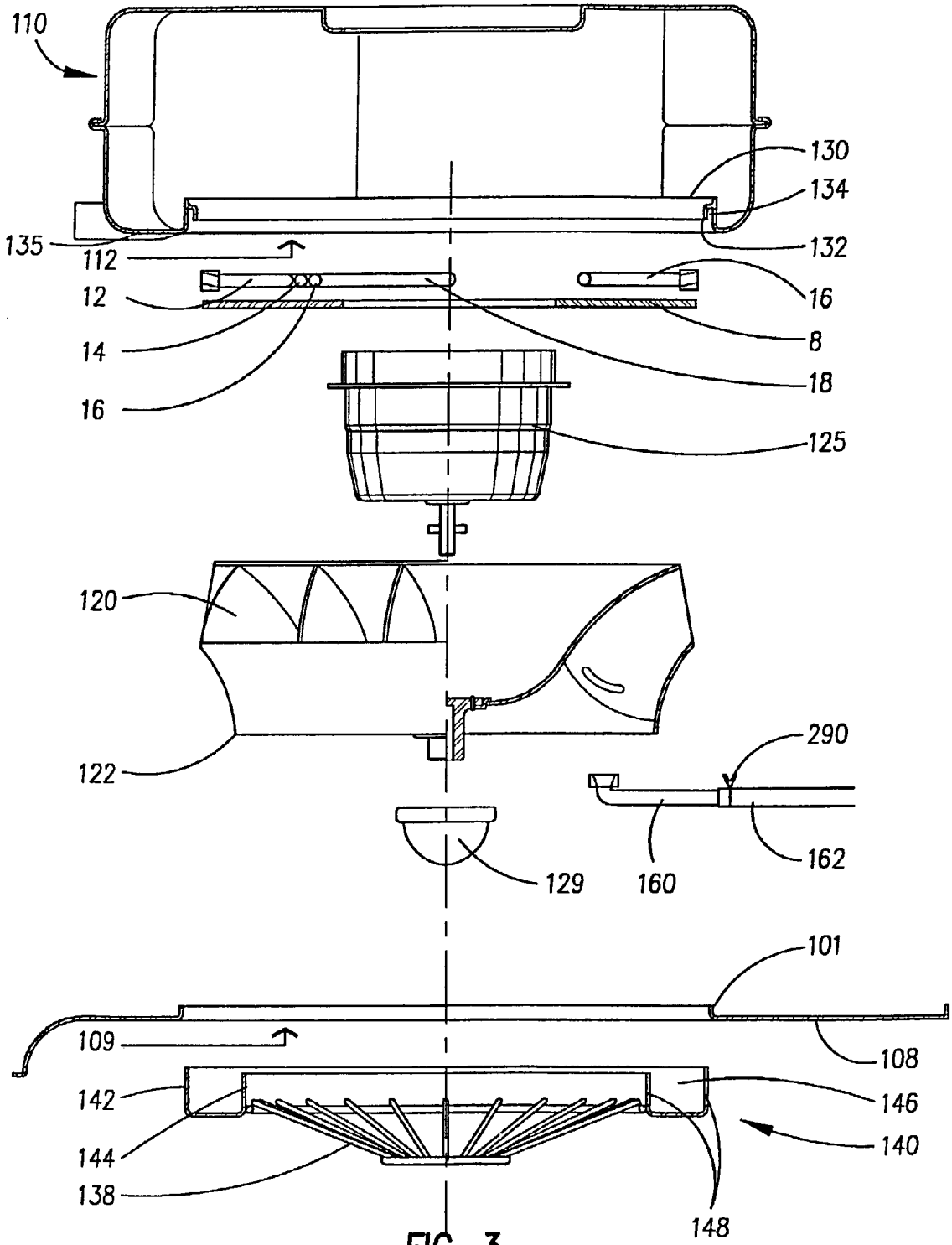
FIG. 3 is an exploded sectional view of portions of the range hood of FIG. 1.

The motors 125 are positioned within the motor housing so that when the fans 120 are attached they are positioned above intake openings 112 (of the motor housing 110) and air inlets 109 (of the lower panel 108), best shown in FIG. 3. The design of the motor housing 110 is such that when the fan is in position, the distance between the fan and the side wall of the motor housing increases in the direction of rotation of the fan, the space being the largest in the area of the ventilation holes, thereby maximizing air flow. This is best illustrated in FIG. 2. In the preferred embodiment, the fans are counter-rotating as indicated by arrows 6, 7 in FIG. 2. However, the cleaning assembly is designed to work with alternative configurations such as where the fans rotate in the same direction.

As shown in FIG. 3, openings 112 in motor housing 110 have walls 130 depending and rising vertically from the lower surface of the motor housing. An outwardly and downwardly projecting extension or lip 132 depends from wall 130, so as to form a gap 134 between the lip 132 and wall 130. Extension 132 may diverge from wall 130 such that gap 134 forms a wedge surface. A tray 140 is dimensioned such that its outer wall 142 may be releasably connected to gap 134. This is discussed in greater detail below.

The lower surfaces of the chambers 2, 4 of the motor housing 110 are each shaped such that any accumulated grease or other condensed liquid (condensate) is directed by gravity towards the respective drain holes 123, 124 (see FIGS. 1, 2). Holes 123, 124 are therefore located at the lowest point of lower surface 118 of the motor housing. As seen in FIG. 3, drainage hoses 127, 128 are attached to each of holes 123 and 124. Accumulated condensate travels through drainage hoses 127, 128 by way of gravity to external grease cups 126 (only one of which is shown in FIG. 1).

Wall 130 acts as a barrier to any condensate which accumulates in the interior of the motor housing, preventing it from dripping through openings 112.

Using chamber 2 as an example, air dispensers of the cleaning assembly, preferably four air hoses 12, 14, 16 and 18 are attached to the upper surface of plate 8 as shown in FIGS. 1, 2 and 3. This configuration is mirrored in chamber 4. Depending on the size of the range hood and the dispersion characteristics of the air hoses and nozzles, less than or more than four air hoses could be used. At the end of each of air hoses 12, 14, 16 and 18 is a nozzle 20. The nozzles 20 are approximately equally spaced about the outer circumference of, and firmly attached to plate 8. The air hoses 12, 14, 16 and 18 pass through a hole in the motor housing and are attached to at least one air compressor (not shown). Preferably the hoses 12, 14, 16 and 18 are collected within rubber covering 24 as shown in FIG. 2, however this need not be the case. It is also contemplated that air hoses 12, 14, 16 and 18 could connect to a larger hose by way of a multi ended adapter or simply pass through the wall of the motor housing individually provided solely that each hose is connected at one end to a compressor and at the other end to a nozzle 20. A plastic or rubber gasket seal (not shown) similar to that employed with respect to the power cord 50 of the motor 125 may be used to prevent any air from escaping from the motor housing where the air dispensers pass through, however anything preventing air from passing through is satisfactory. It is also contemplated that the air hoses 12, 14, 16 and 18 could be combined with the power cord 50 such that they pass through the motor housing wall together.

When in operation, compressed air travels through air hoses 12, 14, 16 and 18 to nozzles 20, which widely disperse compressed air from the air compressor radially outward against the upper surface of the motor housing. This compressed air then follows the contours of the interior of the housing chambers, such that accumulated condensate in each chamber is directed from the upper surface and down the sides towards the lower surface 118 where it is prevented from passing back through openings 112 by walls 130 in troughs 150 formed between wall 130 and the side wall of the motor housing.

Further air dispensers act to direct grease along the bottom surface towards the drainage holes 123, 124. This is accomplished by way of integrated nozzles 42, 44 in the motor housing 110 to which air hoses 26, 28 may be releasably attached as shown in FIG. 2. Air hoses 26, 28 are also attached to a source of compressed air such as an air compressor. While only one integrated nozzle 42 or 44 is shown in each of chambers 2 and 4, it is contemplated that further integrated nozzles could be spaced about the perimeter of the motor housing should greater grease dispersing power be required. Integrated nozzles 42, 44 are positioned within troughs 150 so as to direct a wide spray of compressed air against the lower surface of the motor housing in the respective direction of rotation 6, 7. Air follows troughs 150 forcing condensate around the perimeter of walls 130 towards drainage holes 123, 124. Condensate entering the drainage holes 123, 124 travels to external grease cups 126 by way of drainage hoses 127, 128.

As illustrated in FIGS. 1, 2 and 3, for each compartment the air cleaning assembly also includes a further air hose 162 connected at one end to nozzle 160 and at the other end to an air compressor. The nozzle 160 is positioned so as to direct compressed air from the air compressor against the fans 120 so as to force grease accumulated on the fans 120 into the compartments 2, 4. The nozzle 160 is releasably connectable to the bottom of the motor housing. In this way, it can be disconnected in order to allow the fan, motor or plate to be removed from the interior of the motor housing. Once connected to the motor housing, hose 162 may be releasably attached to the nozzle by way of crip 290 or other means.

The tray 140 while also being releasably connectable to housing 110, also connects to the lower panel 108, which is removable from the remainder of main hood body 102. Lower panel 108 has a pair of air inlets 109, one of which is shown in FIG. 3. Air inlets 109 are defined by circular vertical walls 101, which depend, and rise vertically from, lower surface 108. The circular vertical walls 101 can vary in height between a minimum height and a maximum height. The minimum height is the height at which the circular vertical walls 101 will remain in contact with the tray 140 when it is connected to the housing 110 as described below. The maximum height is the height at which the top of the circular vertical walls 101 abuts the bottom of the nozzle 160 when the lower panel 108 is connected with hood body 102.

Tray 140 is connected to the range hood 100 by inserting it through intake opening 109 in lower panel 108 and into intake opening 112 in the motor housing 110 until outer wall 142 is firmly in place within gap 134. Tray 140 may be releasably connected to housing 110 by wedging outer wall 142 into gap 134. When connecting the tray 140, it must be positioned so as to line-up gap 148 (shown in FIG. 3) with nozzle 162 such that the nozzle is positioned tightly within the gap 148. When tray 140 is connected to the housing 110, outer wall 142 is also in contact with lower panel 108 and acts to seal any space that may exist between the housing and the lower panel thereby preventing air from entering into any undesired area within the range hood body 102. A clip or other form of suitable restraint (not shown) accessible on the outside surface of the range hood is used to hold the tray in place. In this way, lower panel 108 need not be removed in order to access the interior of the motor housing 110. A user need simply remove the tray in order to access the interior of the housing.

Grease accumulated on the fans and within the motor housing, is therefore forced out of the range hood by air delivered by air hoses 162, 12, 14, 16, 18, 26, and 28. The preferred embodiment therefore covers 3 main areas: the fans, the upper to lower interior of the motor housing and the lower surface of the motor housing. It is contemplated, however, that other embodiments could cover one or more of these areas.

Preferably, plates 8 will be made of metal and will be of similar thickness to the motor housing. However, it is also contemplated that other solid substances such as plastic could be used. The plate can be a variety of shapes provided that it provides a surface upon which to mount the air dispensers and protects the air dispensers from coming into contact with the fans. For example, the plate could be star-shaped, with an air hose and nozzle mounted at each but one point of the star, at which point all the air hoses will meet so as to exit the housing 110 en masse. However, as discussed above, it is preferred that the plate be circular as this provides the least interference with the air flow within the chambers 2, 4 when the range hood 100 is in operation. The plate need not be continuous, and in the preferred embodiment has gap 10 which is dimensioned to allow the power cord 50 from motors 125 to fit within it. Alternatively, the plate could have a rounded trough, dimensioned to provide sufficient space for the motor power chord to fit within when the motor 125 and plate 8 are attached to the motor housing 110. Similarly, while in the preferred embodiment the air hoses will be attached to the upper surface of the plate 8 by way of flexible metal loops welded to the plate (not shown), it is also contemplated that other methods of connection could be used, such as glue, or plastic molding.

Figure 4:
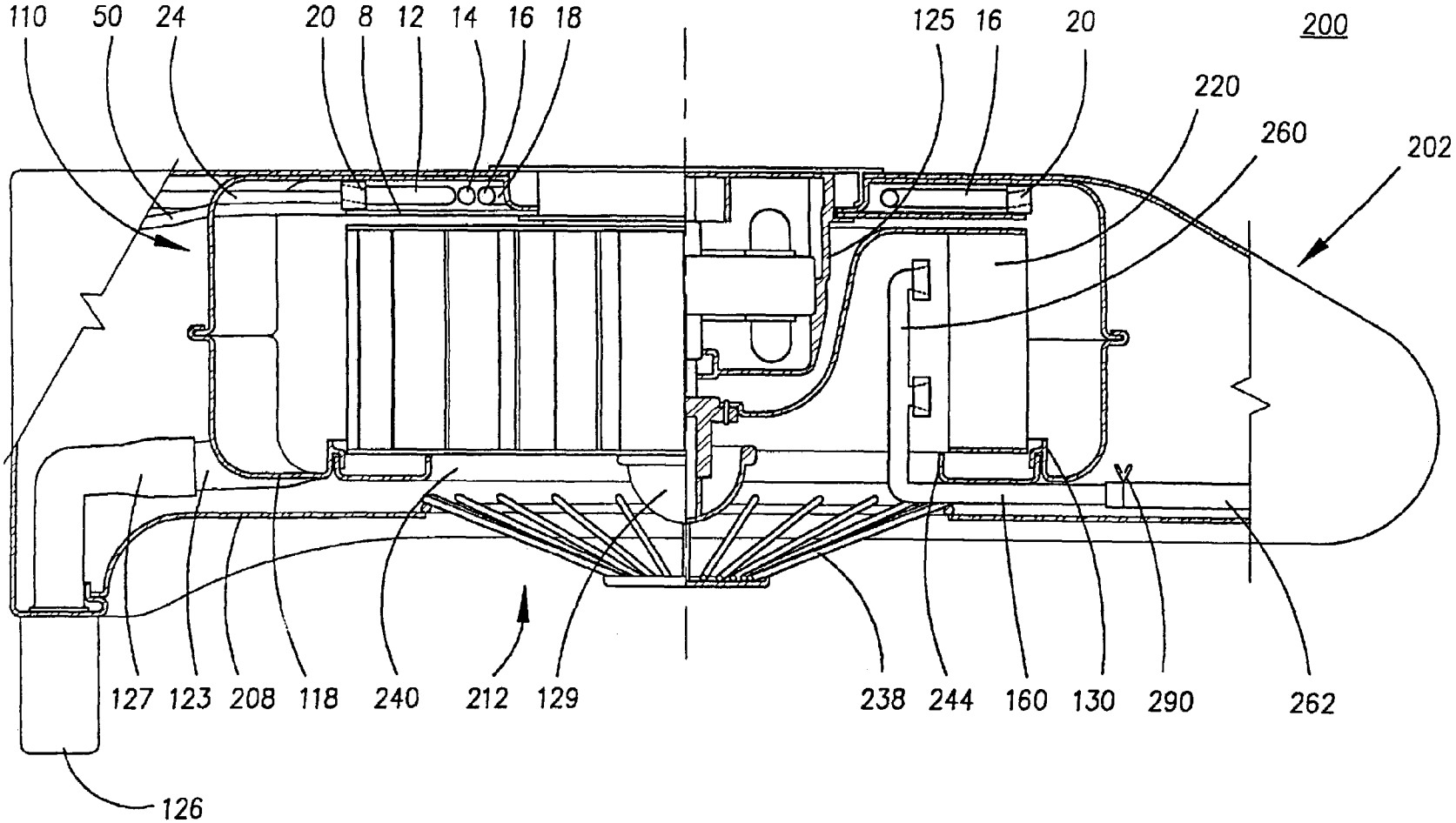
FIG. 4 is a sectional view of a range hood according to an alternative embodiment of the invention with the right hand portion of the figure providing a deeper sectional view than the left hand portion of the figure.
Figure 5:
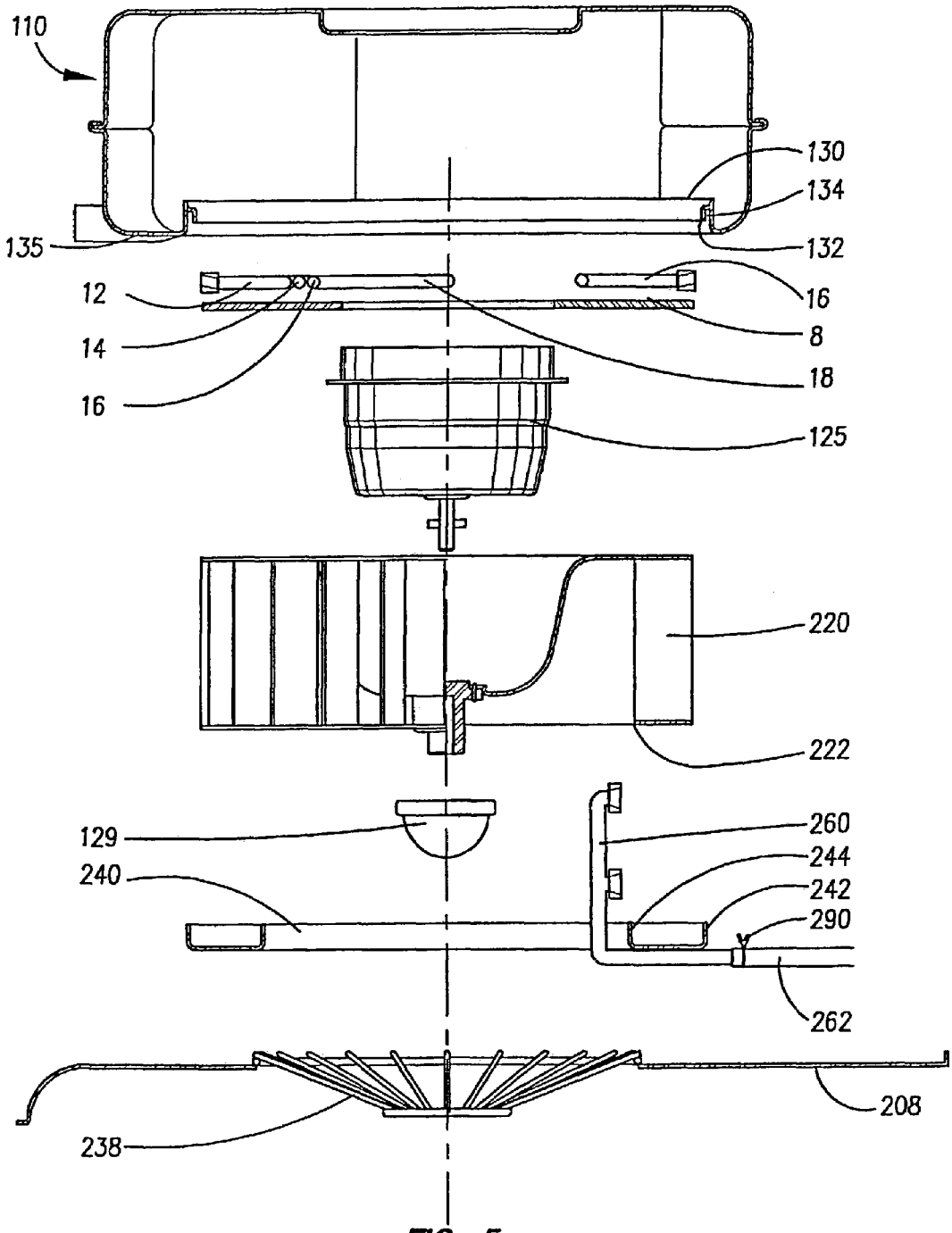
FIG. 5 is an exploded sectional view of portions of the range hood of FIG. 4.

An alternative embodiment is shown in FIGS. 4 and 5. Range hood 200 has motor housing 110 within hood body 202. In this embodiment fan 220 is of the squirrel cage type and is attached to motor 125. In order to remove grease from the fan 220, nozzle 260 is used. At one end nozzle 260 has twin heads for greater dispersion of compressed air against the fan 220. One end of air hose 262 is attached to the other end of nozzle 260, while the other end of air hose 262 is attached to an air compressor. The remainder of the air dispensers of the cleaning assembly are similar to that described in relation to the preferred embodiment shown in FIGS. 1–3.

Range hood 200 also has a different tray 240 and lower panel 108 design. In this embodiment, tray 240 has inner wall 244 and concentric outer wall 242. Inner wall 244 is proximate to, and defines, an opening. Outer wall 242 is distal from the opening in relation to the inner wall 244. Outer wall 242 is shaped and dimensioned to fit within gap 134 when tray 240 is connected with housing 110 so that a portion of outer wall 142 is in abutment with wall 130. Preferably, the diameter of inner wall 244 is smaller than the diameter of lower fan edge 222. The tray 240 is dimensioned such that when connected with the motor housing 110, the top of inner wall 244 is just below the level of fan 220, thereby directing air into the housing 110 by way of the fan 220.

Nozzle 260 may be releasably or permanently attached to tray 240 such that when the tray is connected to motor housing 110, hose 260 may then be attached to nozzle 262. Connection means such as a crip 290 are used to connect air hose 262 to one end of nozzle 260. It is contemplated that other methods of connection would be equally viable. Compressed air from the compressor is sent through air hose 262 and is dispersed by nozzle 260 against fan 220 thereby blowing any accumulated grease into the interior of the motor housing 110.

In order to access the interior of the range hood, one must remove lower panel 208, which has integrated fan grill 238 to prevent insertion of objects into the fan 220.

Figure 6:
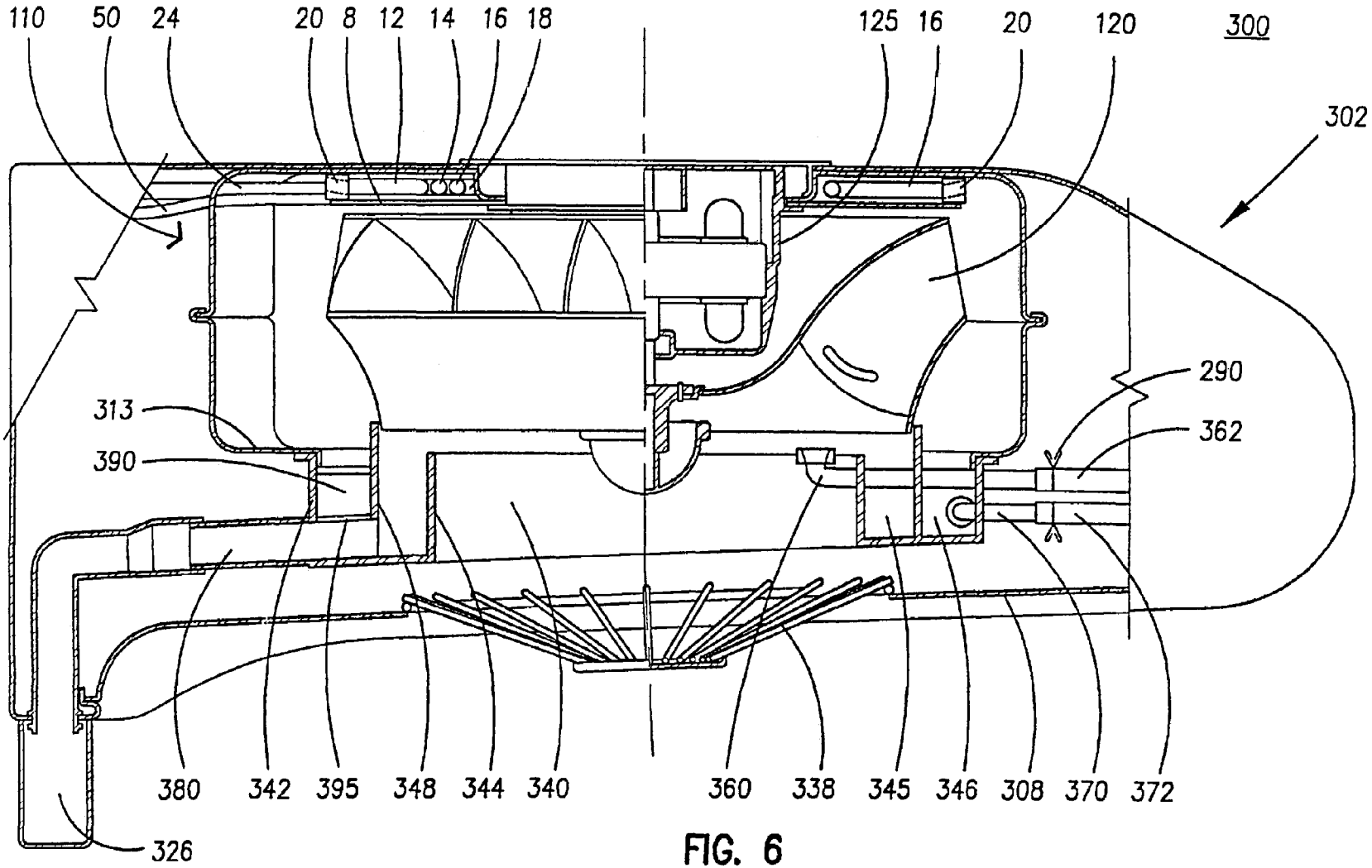
FIG. 6 is a sectional view of a further alternative embodiment of a range hood according to the invention with the right hand portion of the figure providing a deeper sectional view than the left hand portion of the figure.
Figure 7:
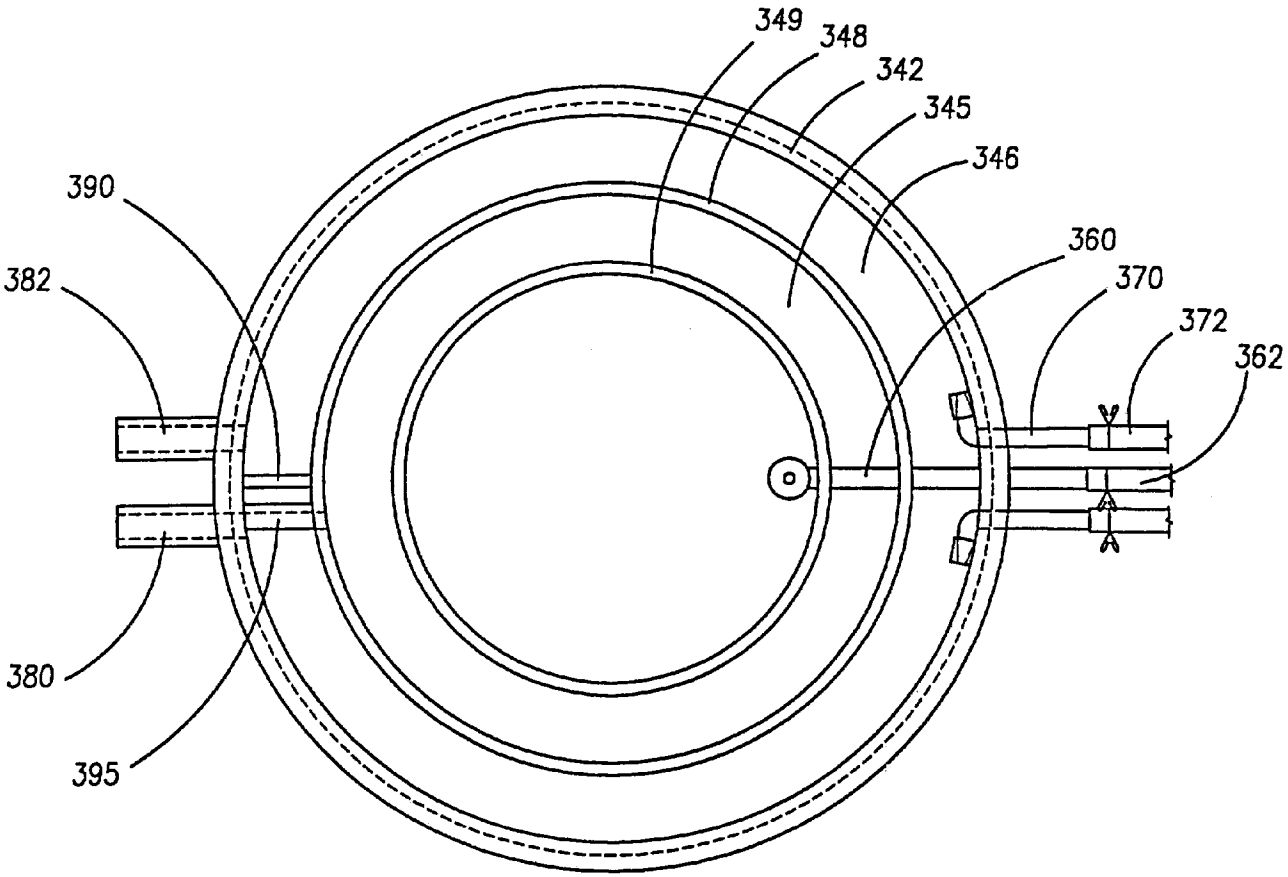
FIG. 7 is a plan view of the grease tray of the range hood of FIG. 6.

A further alternative embodiment of a range hood 300 is shown in FIGS. 6 and 7. Enclosed in hood body 302, motor housing 310 is compartmentalized in a similar fashion to the housing 110 of the preferred embodiment. However, the lower surface 313 of motor housing 310 is shaped such that grease accumulated in the housing interior drains into tray 340. The air dispensers 12, 14, 16, 18 are the same as in the preferred embodiment and act to force condensate from the upper surface and down the sides to the lower surface of the motor housing and finally into tray 340. The force generated by the air of air hoses 12, 14, 16 and 18 is sufficient to drive accumulated grease down the sides of the housing towards tray 340. Accordingly, there is no need for an additional air hose/nozzle in the side of the housing to drive the grease along the bottom as in the preferred embodiment.

Tray 340 has outer wall 342, inner wall 344, separating wall 348, outer trough 346 and inner trough 345. Separating wall 348 acts to control air flow into the motor housing as is known in the art. Most condensate drains into outer trough 346.

However, a very small amount may drain into inner trough 345. Integrated nozzles 370, pass through outer wall 342 such that they are facing in opposite directions. Air hoses 372 connected to an air compressor may be releasably attached to nozzles 370. Compressed air delivered through air hoses 372 is directed by nozzles 370 about the circumference of outer trough 346, thereby forcing any accumulated condensate towards drainage holes 380 and 382. Alternatively, a single nozzle having twin heads could be used such that the number of nozzles passing through the tray is reduced.

An integrated fan nozzle 360 passes through each of walls 342, 348 and 344. Air hose 362 attached to an air compressor may be releasably attached to the fan nozzle 362. Compressed air travelling through air hose 362 is directed by fan nozzle 360 against the fan 120 thereby forcing any accumulated grease into the interior of the motor housing where is is then forced down to tray 340. As shown in FIG. 7, channel 395 travels from inner trough 345 through wall 348, outer trough 346 to wall 342 where it combines with drainage hole 380. Drainage hole 382 is located on the opposite side of a partition wall 390, thereby allowing grease forced around that side of the tray to drain out of the range hood. Grease drains through drainage holes 380 and 382 to external grease cup 326.

To access the motor housing interior, first lower panel 308 with integrated fan grill 338 must be removed from the remainder of the hood body 302. Using clips 290, hoses 362 and 372 are removed from nozzles 360 and 370 respectively, before removing tray 340.

As is apparent from the three embodiments described above, the cleaning assembly of the present invention may be adapted for various range hood designs. The main elements of the system being a source of compressed air and air dispensers to direct the compressed air against grease coated surfaces so as to force grease out of the range hood. Further alternative embodiments of the invention are contemplated by combining different fan types with different motor housing and grease tray designs.

The cleaning assembly of the invention may be activated in one of two ways. First, the range hood may be adapted such that the air compressor(s) of the cleaning assembly is automatically activated for a set period of time each time the range hood is shut off. The duration of air compressor activity may be varied, however it preferably lasts for approximately 15 seconds.

Alternatively, the air compressor of the cleaning assembly may be activated manually. In this way, if the range hood is subjected to particularly greasy vapour on a given day, the cleaning assembly may be activated manually in order to ensure that sufficient air is blown through the system to drive out all the accumulated grease.

Typically only a very small amount of grease accumulates on a fan as most is dispersed by means of the centripetal force of the rotating fan. However, any grease or liquid that remain on the fan will be blown to the interior of the housing by compressed air as discussed with respect to the various embodiments above. The compressed air directed against the fan will cause the fan to turn due to the force exerted on the fan blades, thereby ensuring that each blade of the fan is struck by compressed air in turn. The fan is prevented from spinning too rapidly by the natural resistance of the motor 125. As a result of the grease being removed from the fan, very little grease accumulates in the trays 140 and 240 and inner trough 345, and they need only be checked, and cleaned if necessary, during regular maintenance of the range hood and need only have minimal depth.

It will be appreciated by those skilled in the art that the preferred and alternative embodiments have been described in some detail but that certain modifications may be practiced without departing from the principles of the invention.

The invention claimed is:

1. A cleaning assembly for use in a range hood comprising a motor housing having an interior defined by upper, lower and side surfaces containing at least one motor and at least one fan and having at least one drain hole, said cleaning assembly comprising:

at least one source of compressed air located externally to said motor housing a plate releasably attachable to said motor housing about said motor and above an upper surface of said fan such that there is a space between said plate and said motor housing; and a plurality of air dispensers for delivering said compressed air to said interior.

2. The cleaning assembly of claim 1 wherein at least a first one of said air dispensers is mounted to said plate in said space.

3. The cleaning assembly of claim 2 wherein said air dispensers direct compressed air from said source of compressed air against said upper surface of said motor housing interior.

4. The cleaning assembly of claim 2 wherein at least a second one of said plurality of air dispensers is releasably attachable to said lower surface of said motor housing, said second one of said air dispensers directing compressed air from said source of compressed air against said at least one fan.

5. The cleaning assembly of claim 4 wherein at least a third one of said plurality of air dispensers is integral with said side of said motor housing, said third one of said air dispensers being positioned within said motor housing interior above a top side of said lower surface of said motor housing.

6. The cleaning assembly of claim 5 wherein said third one of said air dispensers directs compressed air from said source of compressed air against said top side of said lower surface of said motor housing.

7. The cleaning assembly of claim 1 wherein at least four of said air dispensers are mounted to said plate in said space.

8. The cleaning assembly of claim 1 wherein said air dispensers comprise air hoses and nozzles, each air hose having a first end connectable to said source of compressed air and a second end releasably connectable with a respective one of said nozzles.

9. A cleaning assembly for use in a range hood comprising a motor housing having an interior defined by upper, lower and side surfaces containing at least one motor and at least one fan, and a grease tray releasably attachable to said motor housing, said grease tray comprising an opening, first, second and third tray walls extending around said opening, a first trough formed between said first and second tray walls, a second trough formed between said second and third tray walls, and at least one drainage hole, said cleaning assembly comprising:

at least one source of compressed air located externally to said motor housing a plurality of air dispensers for delivering said compressed air to said interior.

10. The cleaning assembly of claim 9 wherein at least a first of said plurality of air dispensers is integral with said first, second and third tray walls.

11. The cleaning assembly of claim 10 wherein said first of said air dispensers directs compressed air from said source of compressed air against said at least one fan.

12. The cleaning assembly of claim 11 wherein at least a second one of said plurality of air dispensers is integral with said first tray wall, said second one of said air dispensers directing compressed air from said source of compressed air into said first trough.

13. The cleaning assembly of claims 9 wherein said air dispensers comprise air hoses and nozzles, each air hose having a first end connectable to said source of compressed air and a second end releasably connectable with a respective one of said nozzles.

14. A range hood cleaning assembly, said range hood having a motor housing having upper, lower and side surfaces that generally defines an enclosure containing at least one motor and at least one fan, said lower surface having at least one intake opening and at least one drain hole, said intake opening being defined by a wall extending from said lower surface and projecting into the interior of said enclosure, and a tray releasably connectable to said intake opening, said tray comprising an opening, first and second tray walls extending around said opening, and a floor between said first and second tray walls, said cleaning assembly comprising:

at least one source of compressed air located externally to said motor housing a plate releasably attachable to said motor housing about said motor and above an upper surface of said fan such that there is a space between said plate and said motor housing a plurality of air dispensers for delivering said compressed air within said range hood.

15. The cleaning assembly of claim 14 wherein at least a first one of said air dispensers is mounted to said plate in said space.

16. The cleaning assembly of claim 15 wherein said air dispensers direct compressed air from said source of compressed air against said upper surface within said enclosure.

17. The cleaning assembly of claim 15 wherein at least a second one of said plurality of air dispensers is releasably attachable to said lower surface of said motor housing, said second one of said air dispensers directing compressed air from said source of compressed air against said at least one fan.

18. The cleaning assembly of claim 17 wherein said first and second tray walls have a gap in which said second one of said air dispensers may be fitted when said tray is releasably connected to said intake opening.

19. The cleaning assembly of claim 17 wherein at least a third one of said plurality of air dispensers is integral with said side of said motor housing, said third one of said air dispensers being positioned within said motor housing interior above a top side of said lower surface of said motor housing.

20. The cleaning assembly of claim 19 wherein said third one of said air dispensers directs compressed air from said source of compressed air against said top side of said lower surface of said motor housing.

21. The cleaning assembly of claim 15 wherein at least a second of said plurality of air dispensers is releasably attachable to said tray, said second air dispensers directing compressed air from said source of compressed air against said at least one fan when said tray is releasably connected to said intake opening.

22. The cleaning assembly of claim 14 wherein at least four of said air dispensers are mounted to said plate in said space.

23. The cleaning assembly of claim 14 wherein said air dispensers comprise air hoses and nozzles, each air hose having a first end connectable to said source of compressed air and a second end releasably connectable with a respective one of said nozzles.

* * * * *